US006943758B2

(12) United States Patent
Holtslag et al.

(10) Patent No.: US 6,943,758 B2
(45) Date of Patent: Sep. 13, 2005

(54) SUB-FIELD DRIVEN DISPLAY DEVICE AND METHOD

(75) Inventors: Antonius Hendricus Maria Holtslag, Eindhoven (NL); Roy Van Dijk, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 274 days.

(21) Appl. No.: 10/043,384

(22) Filed: Oct. 26, 2001

(65) Prior Publication Data

US 2002/0126070 A1 Sep. 12, 2002

(30) Foreign Application Priority Data

Oct. 31, 2000 (EP) ..... 00203787

(51) Int. Cl.[7] ..... G09G 3/28

(52) U.S. Cl. ..... 345/63; 345/60; 345/690

(58) Field of Search ..... 345/60–70, 690–693, 345/204; 315/169.01–169.04, 169.1, 169.2, 169.3

(56) References Cited

U.S. PATENT DOCUMENTS

| | | | | | |
|---|---|---|---|---|---|
| 5,619,228 | A | | 4/1997 | Doherty | 345/148 |
| 6,014,258 | A | | 1/2000 | Naka et al. | 359/618 |
| 6,052,112 | A | * | 4/2000 | Tanaka et al. | 345/596 |
| 6,061,049 | A | | 5/2000 | Pettitt et al. | 345/148 |
| 6,064,356 | A | * | 5/2000 | Shigeta | 345/63 |
| 6,097,358 | A | * | 8/2000 | Hirakawa et al. | 345/63 |
| 6,208,467 | B1 | | 3/2001 | Naka et al. | 359/618 |
| 6,249,265 | B1 | * | 6/2001 | Tajima et al. | 345/63 |
| 6,323,880 | B1 | * | 11/2001 | Yamada | 345/690 |
| 6,429,833 | B1 | * | 8/2002 | Ryeom et al. | 345/63 |
| 6,552,701 | B1 | * | 4/2003 | Tanaka | 345/63 |
| 6,703,991 | B2 | * | 3/2004 | Salters et al. | 345/63 |
| 2001/0040436 | A1 | * | 11/2001 | Salters et al. | 315/169.3 |
| 2003/0193449 | A1 | * | 10/2003 | Wakabayashi et al. | 345/60 |

FOREIGN PATENT DOCUMENTS

| | | | | |
|---|---|---|---|---|
| EP | 0698874 | | 2/1996 | G09G/3/36 |
| EP | 0883295 | A2 | 12/1998 | H04N/5/74 |
| EP | 0896317 | | 2/1999 | G09G/3/28 |
| EP | 0899710 | | 3/1999 | G09G/3/34 |
| EP | 000903718 | A1 * | 3/1999 | G09G/3/28 |
| EP | 1 291 835 | A1 * | 12/2003 | G09G/3/28 |

* cited by examiner

*Primary Examiner*—Amare Mengistu
(74) *Attorney, Agent, or Firm*—Edward W. Goodman

(57) ABSTRACT

In a method and device for a sub-field driving a display device, in which sub-fields are weighted and duplicated for achieving a plurality of gray levels by way of a plurality of sub-fields, the sub-fields are weighted as a ternary distribution of sub-field weights.

15 Claims, 2 Drawing Sheets

| | | | Pixel 1 | | | | | | Pixel 2 | | | | |
|---|---|---|---|---|---|---|---|---|---|---|---|---|---|
| | | | 1 | 3 | 9 | 3 | 1 | | 1 | 3 | 9 | 3 | 1 |
| 0 | s | | | | | | | | | | | | |
| 1 | d | | x | | | | | | | | | | x |
| 2 | s | | x | | | | x | | x | | | | x |
| 3 | d | | | x | | | | | | | | x | |
| 4 | d | | x | | | x | | | | x | | | x |
| 5 | d | | x | x | | | x | | x | | | x | x |
| 6 | s | | | x | | x | | | | x | | x | |
| 7 | d | | x | x | | x | | | | x | | x | x |
| 8 | s | | x | x | | x | x | | x | x | | x | x |
| 9 | s | | | | x | | | | | | x | | |
| 10 | d | | x | | x | | | | | | x | | x |
| 11 | s | | x | | x | | x | | x | | x | | x |
| 12 | d | | | x | x | | | | | | x | x | |
| 13 | d | | x | | x | x | | | | x | x | | x |
| 14 | d | | x | x | x | | x | | x | | x | x | x |
| 15 | s | | | x | x | x | | | | x | x | x | |
| 16 | d | | x | x | x | x | | | | x | x | x | x |
| 17 | s | | x | x | x | x | x | | x | x | x | x | x |

FIG. 2

SUB-FIELD DRIVEN DISPLAY DEVICE AND METHOD

BACKGROUND OF THE INVENTION

1. Field of the Invention

The present invention relates to a sub-field driven display device and method, wherein sub-fields are weighted and duplicated for providing a plurality of gray levels by way of a plurality of sub-fields.

2. Description of the Related Art

Such a sub-field driven display and method are known from European Patent Application No. EP-A-0 896 317, corresponding to U.S. Pat. Nos. 6,014,258 and 6,208,467, which discloses a color image display device wherein color video signals are supplied to red, green and blue light-emitting cells, for example, the cells of a plasma display device. The device employs the known sub-field method of displaying the required gray scale representation by controlling the light-emitting luminous levels of the respective red, green and blue light-emitting cells. In this known sub-field method, one display field is divided into a plurality of sub-fields on a time base, light-emitting weights are allotted to the respective sub-fields, and light emission in each of the respective sub-fields is then controlled in an on/off manner so as to provide the appropriate gray level gradation. The required gradation is commonly provided by employing a binary ratio weighting for the sub-fields.

SUMMARY OF THE INVENTION

It is an object of the invention to provide for a sub-field driven display device and method offering improved performance, which can be disadvantageously limited with such known display devices and methods. In particular, the present invention seeks to provide improved performance through the identification of particular limitations, and related problems, as found in the prior art and which are identified in accordance with the present invention, and arise particularly in view of the number of sub-fields employed, which serves to disadvantageously limit the performance of known devices and methods due to motion artefacts and the limited number of gray levels available.

The present invention further seeks to provide for an improved sub-field driven display device and method which readily allows for the adoption of duplicated sub-field addressing.

According to one aspect of the present invention, there is provided a sub-field driven display device of the type defined above, characterized in that the sub-fields are weighted in accordance with a ternary distribution of sub-field weights.

As will be illustrated further within the present application, the adoption of a ternary distribution of weights advantageously optimizes the ratio of gray levels to sub-fields adopted such that, when compared with known weighting distributions, and for a given number of sub-fields, the present invention advantageously allows for an increased number of gray levels, thereby advantageously enhancing the performance of sub-field driven display devices. Stated in the alternative, the invention, therefore, has the advantage that, with a minimal number of sub-fields, the highest maximum value of gray level can be achieved while still retaining the possibility of also producing all intermediate gray level values.

The above-described display device, wherein the sub-field converter is arranged to employ symmetrical duplicated ternary weights, is particularly advantageous in readily allowing for the application of a duplicated sub-field addressing method which, in turn, advantageously reduces motion artefact problems that can be apparent in such devices.

The above-described display device, wherein the sub-field converter is arranged to distribute the ternary weights in a manner of increasing weighted value toward a central value or values, further facilitates such advantages, and the above-described display, wherein the sub-field converter is arranged to provide the highest sub-field weight at the center of the ternary distribution, has the advantage that, with the heaviest weighting value found within the middle of the sub-field weighting distribution, this central sub-field position can advantageously act as a reference time value for motion compensation.

A method of driving a display device by means of a plurality of weighted and duplicated sub-fields, wherein the weighting of the sub-fields is in accordance with a ternary distribution of weights, and wherein symmetrical duplicated ternary weights are used, specifically introduces the adoption of a duplicated sub-field addressing method which can readily be achieved in accordance with the sub-field distribution arising in the present invention. Such an addressing method allows for motion artefact reduction, even without use of a motion estimator, and even though the method, if required, can be combined with motion compensation based on motion estimation.

BRIEF DESCRIPTION OF THE DRAWINGS

The present invention is described further hereinafter by way of example only, with reference to the accompanying drawings in which:

FIG. 2 comprises a tabular representation gray level production for two pixels in accordance with an embodiment of the present invention.

DESCRIPTION OF THE PREFERRED EMBODIMENTS

Figure 1:
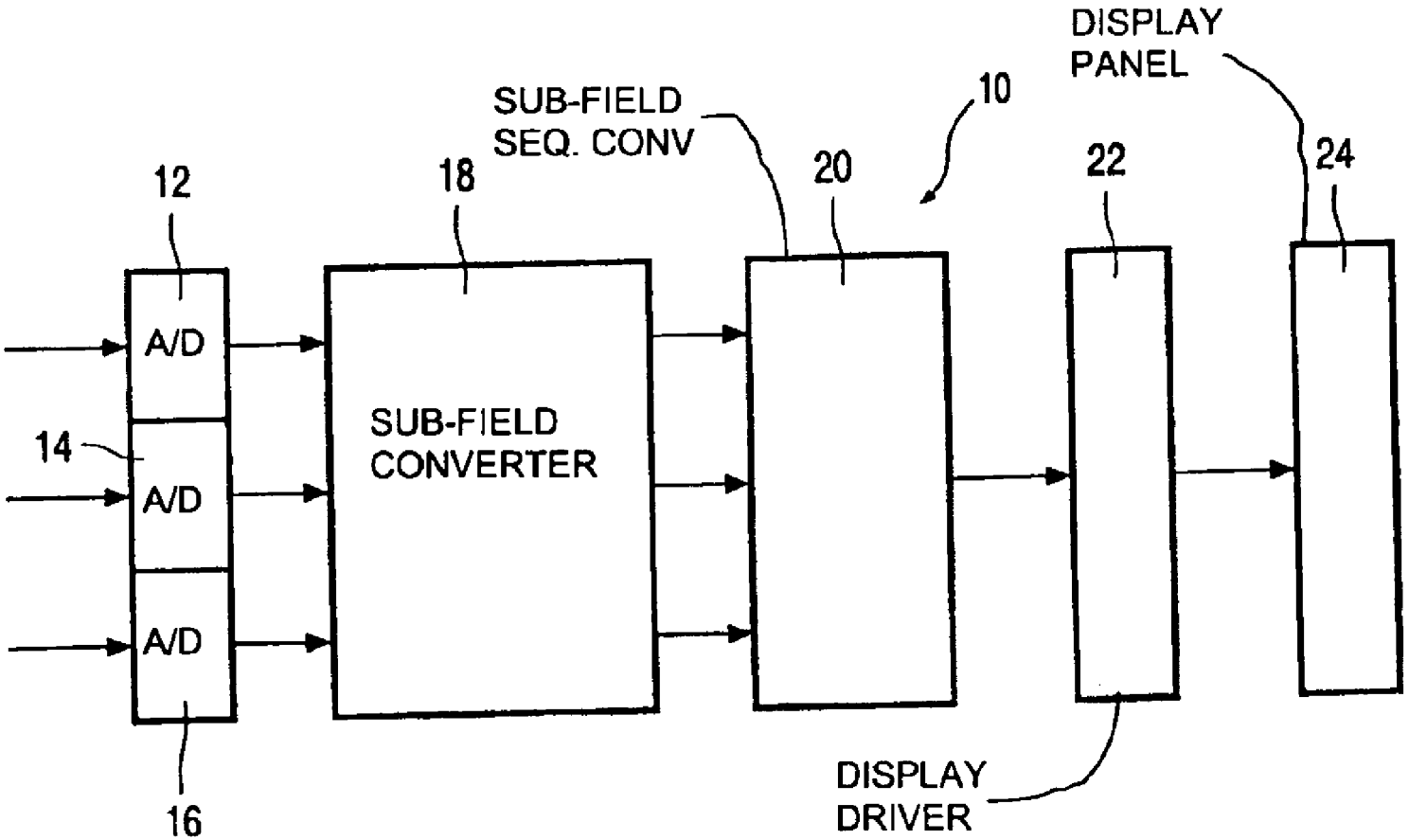
FIG. 1 represents a block diagram of a display device embodying the present invention.

It should be appreciated that the present invention can readily employ the techniques for weighting and distributing duplicated sub-fields as disclosed in European Patent Application Nos. EP-A-0 899 710, EP-A-0 698 874 and EP-A-0 896 317, corresponding to U.S. Pat. Nos. 6,061,049, 5,619,228 and 6,014,258 (and 6,208,467), respectively.

As will be appreciated, the present invention relates to the adoption of a ternary weighting distribution for a sub-field driven display device and related method in which, as will be illustrated below, specific advantages leading to an improved performance in display devices can be achieved.

For example, the ternary distribution:

1,3,9,27,9,3,1 represents a particularly advantageous weighting in accordance with the present invention since the ternary distribution is not only a symmetrical distribution but also offers its maximum value at the center of the distribution.

As will be appreciated, through the effective use of seven sub-fields, i.e., each employing a respective one of the weightings noted above, all integer values of gray level between 0 and the maximum possible gray level, 53 in this example, can be realized. When compared, for example, with a binary distribution as known in the prior art, a greater number of sub-fields will be required in order to arrive at a similar number of gray level values. This is particularly true for symmetrical series.

The ternary distribution has associated advantages in that it readily allows for particularly effective motion artifact reduction through the application of the known duplicated sub-field addressing method which, if required, can be combined with motion compensation based on motion estimation.

As noted in the above example, it is particularly advantageous to provide for the heaviest weighting value in the center of the sub-field weighting distribution since this sub-field position can then readily act as a reference time t=0, for motion compensation. This can be preferred since the maximum amount of light is generated within the middle of the sub-field distribution and is not liable to be effected by any possible truncation error. The lower weights, i.e., the weighting values of the sub-fields on either side of the central heaviest weight, are then effectively duplicated on either side of the central weight and turned on in accordance with the example of two driven pixels as illustrated in the accompanying drawing.

Turning now to Fig. 1, there is illustrated, in block-diagrammatic form, one embodiment of a display device 10 according to the present invention. The device 10 includes analog/digital converters 12, 14, 16 for each of the incoming analog Red, Green and Blue video signals, these converters subsequently supplying the digital video signals to a sub-field converter 18. The signals output from the sub-field converter 18 are received by a sub-field sequence converter 20 including a frame memory which, in turn, supplies the sub-field divided signal to a display driver 22. The display driver 22 is arranged to provide drive signals to the display, such as, a plasma display panel 24.

Referring now to the drawing, shown in FIG. 2, each of the possible 18 gray levels is identified down the left-hand column whereas the ternary weighting for each of the 5 sub-fields of each of pixels 1 and 2 is illustrated across the top row of the table and confirms that the ternary distribution 1,3,9,3,1 is employed for illustrative purposes within this embodiment of the present invention. The distribution of crosses within the table indicates which of the weighted sub-fields is driven in order to provide the particular gray scale level indicated in the left-hand column.

In further detail, consideration can be given to the distribution of (2n+1) values $a_i$:

$a_0, a_1, a_2, a_3, \ldots\ldots, a_{n-1}, a_n, a_{n-1}, \ldots\ldots, a_3, a_2, a_1, a_0,$ while a0 =1

With a number of gray levels, $G_{2n+1}$, equal to (note: consider also the gray value 0):

$$G_{2n+1} = 1 + a_n + 2\sum_{0}^{n-1} a_i$$

The symmetrical distribution is constructed in order to apply the distributed sub-field method. The values an are integer values, such that all values from 0 to $G_{2n+1}$, can be realized.

The heaviest weights will preferably be in the middle of the distribution, while the smaller values are located further away from the middle; therefore, $a_0$=1.

A distribution for n=4 is advantageously constructed as follows:

| $a_0$ | $a_1$ | $a_2$ | $a_3$ | $a_4$ | $a_3$ | $a_2$ | $a_1$ | $a_0$ | Construction comment: |
|---|---|---|---|---|---|---|---|---|---|
| 1 | . . . . . | | | | | | | 1 | sum 2, so take 3 as next DSF number |
| 1 | 3 | . . . . . | | | | | 3 | 1 | sum 8, so take 9 as next DSF number |
| 1 | 3 | 9 | . . . . . | | | 9 | 3 | 1 | sum 26, so take 27 as next DSF number |
| 1 | 3 | 9 | 27 | 81 | 27 | 9 | 3 | 1 | sum 80, finalize with 81 in the middle |

Thus, all integer values between 0 and a maximum gray level of 161 can be produced giving $G_9$=162 gray levels.

In general: $a_n=3^n$, n=0,1,2,3 . . . ,

Giving: 2n+1sub-fields,

While: $G_{2n+1}=2.3^n$.

This provides for a ternary series.

For a symmetrical binary series of (2n+1) sub-fields, with the highest weight in the middle, the number of gray levels equals $G_{2n+1}=2.2^n$, which is a factor $(3/2)^n$ less. At (2n+1)=9 sub-fields (thus n=4), this differs a factor 5.0625 ( 5). This clearly illustrates how, for a given number of sub-fields, the device and method of the present invention can provide for an optimum number of gray scale values.

At an even number of sub-fields, one additional term is generally to be determined. To keep the distribution fully symmetrical, the heaviest weight can be copied, or repeated, in the middle as follows:

$a_0, a_1, a_2, a_3, \ldots, a_{n-1}, a_n, a_n, a_{n-1}, \ldots, a_3, a_2, a_1, a_0,$ while $a_0$=1 example for n=3: 1,3,9,27,27,9,3,1 , $G_8$=81.

Alternatively, a series can be developed in which the term $a_0$ is not duplicated. Using the same values as above, this arrives at:

1,2,6,18,54,18,6,2 which, for the same number of eight sub-fields, gives 108 gray levels.

As will be appreciated, the maximum possible number of gray levels is advantageously achieved in accordance with the present invention while, if required, for the highest of all possible weights, a symmetrical value can also be adopted. When also applying the duplicate sub-field method so as to achieve motion compensation, the pixels identified as A pixel and B pixel in the duplicated sub-field method can advantageously be addressed by one of the symmetrical options.

It should of course be appreciated that the present invention can be used in all displays which employ sub-field distributions and include, but are not limited to, Plasma Display Panels, Digital Mirror Devices and Dynamic Foil Displays.

Also the invention is not restricted to the details of the foregoing embodiment since, for example, an asymmetrical ternary distribution, and without having the highest weighted value centrally located, could still nevertheless advantageously be employed so as to arrive at advantages offered by the present invention.

What is claimed is:

1. A sub-field driven display device having a sub-field converter for converting video signals into sub-field data in which the sub-fields are weighted and duplicated for achieving a plurality of gray levels by way of a plurality of sub-fields, characterized in that the sub-field converter weights the sub-fields in a ternary distribution of sub-field weights.

2. The display device as claimed in claim 1, wherein the sub-field converter employs symmetrical duplicated ternary weights.

3. The display device as claimed in claim 1, wherein the sub-field converter distributes the ternary weights in a manner of increasing weighted value toward a central value or values.

4. The display device as claimed in claim 1, wherein the sub-field converter provides the highest sub-field weight at the center of the ternary distribution.

5. The display device as claimed in claim 1, wherein said display device further comprises motion compensation means employing motion estimation for enhancing motion artefact reduction.

6. The method as claimed in claim 5, wherein said method further comprises the step of:

duplicated sub-field addressing.

7. The method as claimed in claim 6, wherein said method further comprises the step:

motion compensation employing motion estimation for enhance motion artefact reduction.

8. The method as claimed in claim 6, wherein the method further comprises the step of:

alternating light output control patterns in predetermined units of the display.

9. The method as claimed in claim 8, wherein the pattern comprises a checker-board pattern.

10. The display device as claimed in claim 1, wherein the sub-field converter alternates light output control patterns in predetermined units of the display.

11. The display device as claimed in claims 10, wherein the pattern comprises a checker-board pattern.

12. A method of driving a display device in a plurality of weighted and duplicated sub-fields, characterized in that said method comprises the step:

weighting the sub-field in a ternary distribution of weights.

13. The method as claimed in claim 12, wherein said step of weighting the sub-fields employs symmetrical duplicated ternary weights.

14. The method as claimed in claim 12, wherein the ternary weights are distributed in a manner of increasing weighted value toward a central value or values.

15. The method as claimed in claim 12, wherein the highest sub-field weight is found in the center of the ternary distribution.

* * * * *